US007448568B2

(12) United States Patent
Katsumura et al.

(10) Patent No.: US 7,448,568 B2
(45) Date of Patent: Nov. 11, 2008

(54) SHREDDER WITH ROTATABLE SIDEWALL

(75) Inventors: Hikoichi Katsumura, Hirakata (JP); Saiji Yamashita, Hirakata (JP); Satoshi Ishii, Hirakata (JP)

(73) Assignee: Matsui Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/388,605

(22) Filed: Mar. 24, 2006

(65) Prior Publication Data

US 2006/0180688 A1 Aug. 17, 2006

Related U.S. Application Data

(63) Continuation of application No. 10/494,167, filed on Apr. 29, 2004, now Pat. No. 7,216,824.

(30) Foreign Application Priority Data

Sep. 19, 2002 (JP) ..... 2002-272376
Jul. 28, 2003 (WO) ..... PCT/JP03/09551

(51) Int. Cl.
*B02C 1/08* (2006.01)
*B02C 7/00* (2006.01)
*B02C 13/00* (2006.01)

(52) U.S. Cl. ..... 241/243; 241/237

(58) Field of Classification Search ..... 241/144, 241/152.2, 237–240, 243, 267
See application file for complete search history.

(56) References Cited

U.S. PATENT DOCUMENTS 2,014,859 A * 9/1935 Mitchell, Jr. ..... 384/480
3,545,689 A * 12/1970 Luscombe ..... 241/186.4
3,708,127 A * 1/1973 Brewer ..... 241/32
5,454,522 A * 10/1995 Ballu ..... 241/237
5,487,509 A * 1/1996 Hama ..... 241/152.2
5,611,495 A 3/1997 Williams
5,906,322 A * 5/1999 Hama ..... 241/152.2
6,094,795 A * 8/2000 Davenport ..... 29/407.1
6,783,264 B2 * 8/2004 Felty ..... 362/371

FOREIGN PATENT DOCUMENTS

JP 61-3461 Y2 2/1986

(Continued)

OTHER PUBLICATIONS

Plas-aid, Produced by Matsui: Recycle Equipment, The low-speed type Granulater sweeper/SMGL Series; by Matsui; Jan. 31, 2002.
Plucky; by Watanabe Seikosho; Sep. 2002.
Gran Cutter, Gran Mixer; by Harmo Co., Ltd.; Oct. 2002.
Scutter-Sx; by Stolz Co., Ltd.; $2_{nd}$ Edition, 2005.

*Primary Examiner*—Bena Miller
(74) *Attorney, Agent, or Firm*—R. Neil Sudol; Henry D. Coleman; William J. Sapone

(57) ABSTRACT

A shredder for shredding a by-product, such as sprue, runner and the like generated when molding a thermoplastic synthetic resin product, into recyclable shredded pieces, is structured such that front and rear oscillating side walls are openable, right and left stationary side walls are connected by two support shafts and one connection member, and two support shafts serve as pivot axes of the oscillating side walls and connection members connecting the right and left stationary side walls.

10 Claims, 7 Drawing Sheets

FOREIGN PATENT DOCUMENTS

| | | | |
|---|---|---|---|
| JP | 6-16016 | | 3/1994 |
| JP | 3108384 | | 5/1997 |
| JP | 3045106 | U | 1/1998 |
| JP | 10-118515 | A | 5/1998 |
| JP | 2002-1147 | | 1/2002 |
| TW | 128239 | | 2/1990 |
| TW | 191754 | | 10/1992 |
| TW | 265275 | | 12/1995 |
| TW | 430574 | B | 4/2001 |
| TW | 434129 | B | 5/2001 |

* cited by examiner

SHREDDER WITH ROTATABLE SIDEWALL

CROSS-REFERENCE TO RELATED APPLICATION

This application is a continuation of application Ser. No. 10/494,167 filed Apr. 29, 2004 now U.S. Pat. No. 7,216,824.

TECHNICAL FIELD

The present invention relates to a shredder which is suitable for shredding a by-product (a sprue, a runner and the like), for example, which is generated in accordance with a molding of a thermoplastic synthetic resin product, into reusable shredded pieces.

BACKGROUND ART

In conventional, the following structure is known as this kind of shredder.

There has been known a shredder comprising:

a lower casing which has an outlet in a lower portion and is formed in a rectangular plan shape;

an upper casing which is provided on the lower casing so as to be freely opened and closed by vertically oscillating movement, and is formed in a rectangular plan shape;

a rotary shaft which is rotatably provided between right and left side walls of the lower casing in the state of the axis thereof being in a lateral direction, and has a rotary blade;

a stationary blade which is provided in an inner side of a front wall of the upper casing and shreds a subject to be treated in cooperation with the rotary blade; and a scraper which is provided in an inner side of a rear wall of the upper casing, wherein the rotary blade is positioned between the stationary blade and the scraper (refer to Japanese Unexamined Utility Model Publication No. 6-16016).

The conventional shredder has the following defects.

Since the upper casing is freely opened and closed by oscillating movement with respect to the lower casing, however, the lower casing and the upper casing are formed in the rectangular frame shape in the plan view, there has been a defect that it is hard to perform a maintenance and a cleaning.

DISCLOSURE OF THE INVENTION a shredder according to a first embodiment of the present invention comprises (a) a pair of stationary side walls arranged with a predetermined interval or a predetermined spacing from one another, (b) a rotary shaft rotatably bridged over the stationary side walls and having a rotary blade, (c) a pair of support shafts bridged and fastened over lower end portions of the pair of stationary side walls in parallel with the rotary shaft, (d) oscillating side walls provided to each of the support shafts so as to freely oscillate to be opened and closed, (e) a stationary blade provided in an inner side of one of the oscillating side walls and shredding a material to be treated in cooperation with the rotary blade, and (f) a scraper provided in an inner side of the other oscillating side wall, wherein the rotary blade is positioned between the stationary blade and the scraper, and wherein the rotary blade is provided with an arm-shaped roughly cutting rotary blade and a finely cutting rotary blade having sawtooth-shaped shredding teeth in an outer periphery. a cover member for covering a moving locus space of the roughly cutting rotary blade is provided so as to be positioned below the stationary blade and the scraper. The cover member has (1) a first side member provided in one of the oscillating side walls, (2) a second side member provided in the other oscillating side wall, and (3) an intermediate member connecting the first side member and the second side member, the intermediate member being independent of the first and second side members and detachable.

In accordance with the first embodiment of the invention, since the oscillating side walls (front and rear) are opened, it is easy to perform maintenance. Further, since two support shafts serve as both the pivot axes of the oscillating side walls and the connection members connecting the right and left stationary side walls, it is possible to reduce the number of the parts so as to reduce cost. Moreover, since the intermediate member of the cover member is detachably provided, it is easy to perform maintenance.

Pursuant to a further feature of the present invention, a left spiral portion is formed on an inner portion of an end portion of the rotary shaft, a right spiral portion is formed on an inner portion of the other end portion thereof, and the left and right spiral portions are formed so as to oppose to the inner surfaces of holes in the stationary side walls in which the rotary shaft is fit.

In accordance with this further feature of the invention, since a left spiral portion is formed on an inner portion of an end portion of the rotary shaft, a right spiral portion is formed on an inner portion of the other end portion thereof, and the left and right spiral portions are formed so as to oppose to the inner surfaces of holes in the stationary side walls in which the rotary shaft is fit. Therefore, a material to be treated (including the shredded pieces) entering into a portion between the left and right spiral portions and the inner surfaces of the holes is discharged to an inner portion of the casing, thus preventing the trouble that the material fits in and is crowded with a bearing.

Pursuant to another feature of the present invention, a rectangular hole is formed in a side wall of the roughly cutting rotary blade. This feature makes it possible to fit a rotating tool in the rectangular hole and to turn the roughly cutting rotary blade by hand.

According to an additional feature of the present invention, the stationary blade and the scraper are fixed with bolts in an inner side of the oscillating side wall and in an inner side of the other oscillating side wall respectively, and a head portion of each bolt is formed in an upward convex curved shape. This makes it possible to prevent the material to be treated from fitting in and being crowded with the head of the bolt.

Pursuant to yet another feature of the present invention, the shredder further comprises (i) a lock piece having tapered surfaces, which are opposed to each other and open toward a leading end side in a plan view and which have a C shape in a plan view, (ii) a through hole formed in the lock piece, (iii) an inclined surface formed in the stationary side wall and in the oscillating side wall respectively, so as to oppose to the taper surfaces, and (iv) a threaded hole formed in the stationary side wall in which a screw penetrating the through hole is screwed, wherein the oscillating side wall is fixed to the stationary side wall by fastening the screw so as to press the taper surfaces against the inclined surfaces. Since the taper surfaces are made to oppose to the inclined surfaces and then fastening the screw so as to press the taper surfaces against the inclined surfaces, it is possible to lock the oscillating side wall to the stationary side wall, thereby increasing the rigidity of the shredder.

a shredder according to a second embodiment of the present invention comprises (A) a pair of stationary side walls arranged with a predetermined interval, (B) connection members bridged and fastened over upper portions of the stationary side walls, (C) a rotary shaft rotatably bridged over the stationary side walls and having a rotary blade, (D) a pair of support shafts bridged and fastened over lower end portions of the pair of stationary side walls in parallel with the rotary shaft, (E) oscillating side walls provided to each of the support shafts so as to freely oscillate to be opened and closed, (F) a stationary blade provided in an inner side of one of the oscillating side walls and shredding a material to be treated in cooperation with the rotary blade, and (G) a scraper provided in an inner side of the other oscillating side wall, wherein the rotary blade is positioned between the stationary blade and the scraper, and wherein the rotary blade is provided with an arm-shaped roughly cutting rotary blade and a finely cutting rotary blade having sawtooth-shaped shredding teeth in an outer periphery.

Pursuant to the second embodiment of the invention, since the front and rear oscillating side walls are openable, it is easy to perform maintenance. Moreover, since the right and left stationary side walls are connected by two support shafts and one connection member, it is possible to increase the rigidity of the shredder. Further, since two support shafts serve doubly as the pivot axes of the oscillating side walls and the connection members connecting the right and left stationary side walls, it is possible to reduce the number of the parts so as to reduce cost.

BEST MODE FOR CARRYING OUT THE INVENTION a description will be given below of an embodiment in accordance with the present invention.

Figure 1:
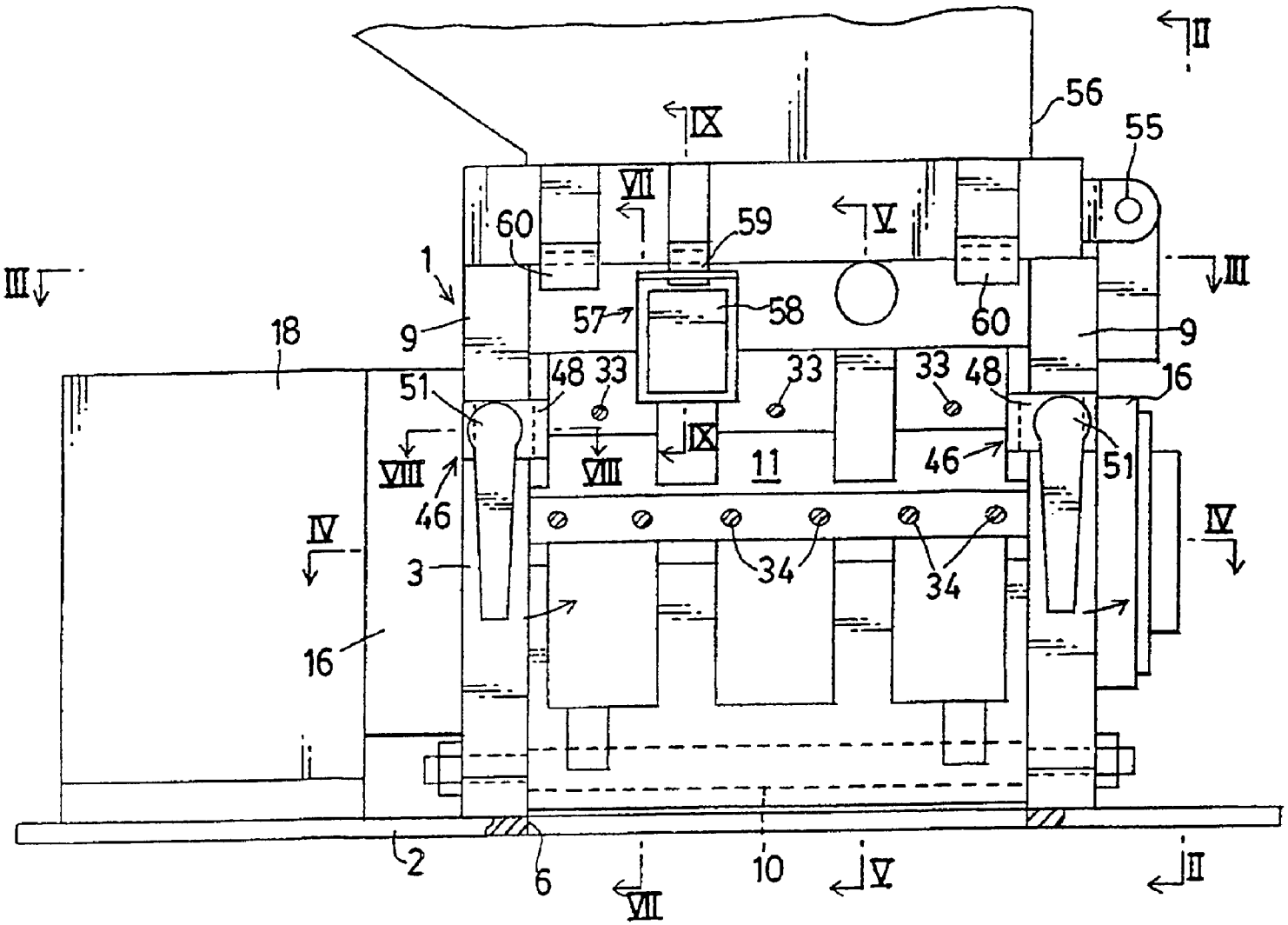
FIG. 1 is a front view of a main portion showing an embodiment in accordance with the present invention.
Figure 2:
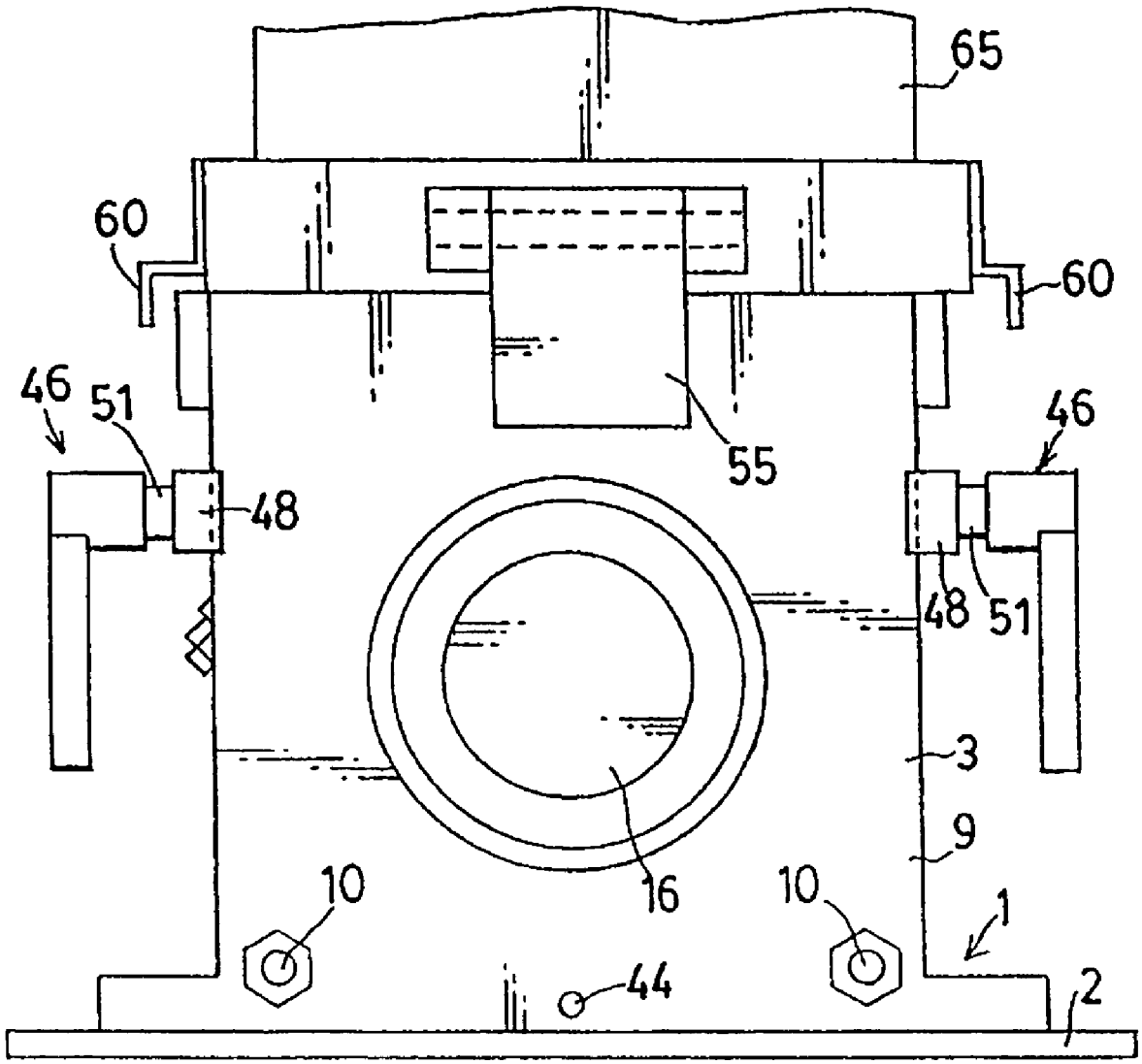
FIG. 2 is a cross sectional view along a line II-II in FIG. 1.

In this case, in the description, front means a top side of a paper surface in FIG. 1, rear means a back side of the same, left means a left side in FIG. 1, and right means a right side in FIG. 1.

a casing 3 mounted to a horizontal base plate 2 of a shredder 1 has an inlet 4 in an upper portion and an outlet 5 in a lower portion. An opening 6 is formed in the base plate 2 so as to oppose to the outlet 5. a receiving box (not shown) for receiving shredded pieces is arranged below the opening 6 of the base plate 2.

The casing 3 has right and left stationary side walls 9 arranged with a predetermined interval in the right-and-left direction, front and rear support shafts 10 bridged and fastened over lower portions of front and rear portions of the stationary side walls 9, front and rear oscillating side walls 11 provided to the support shafts 10 so as to freely oscillate forward and backward and to be opened and closed, and a connection member 12 bridged and fastened over upper front portions of the right and left stationary side walls 9. The support shafts 10 have a function of pivot shafts supporting the oscillating side walls 11 so as to freely oscillate, and connection members connecting the stationary side walls 9. In this case, the front oscillating side wall 11 is structured such that the front oscillating side wall 11 does not oscillate rearward beyond a position shown in FIG. 5 by being brought into contact with the connection member 12, and the rear oscillating side wall 11 is structured such that the rear oscillating side wall 11 does not oscillate frontward beyond a position shown in FIG. 5 by being brought into contact with a stopper (provided in the stationary side wall 9) (not shown).

Figure 4:
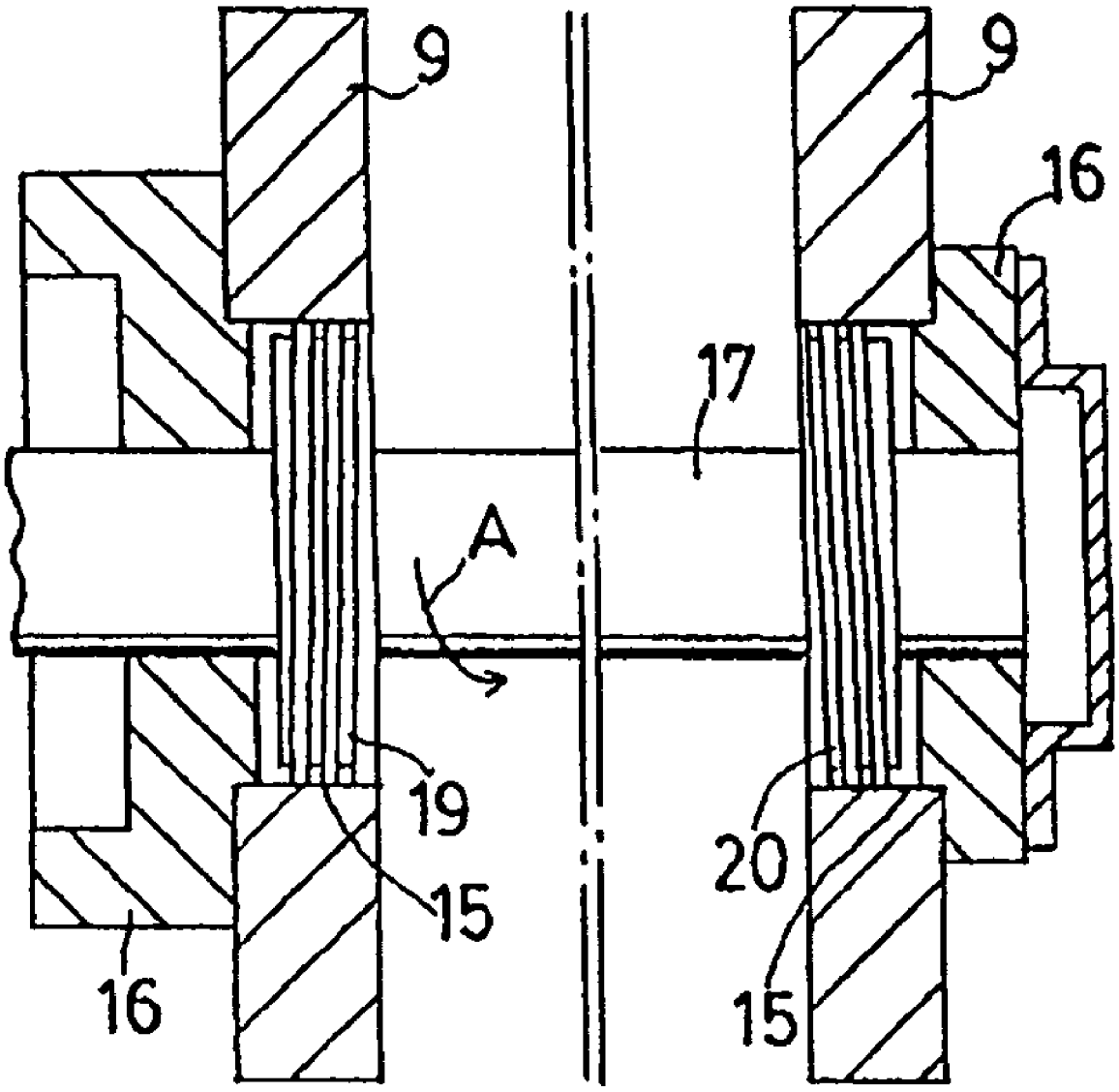
FIG. 4 is a cross sectional view showing only a main portion along a line IV-IV in FIG. 1 from which an intermediate portion is omitted.

As shown in FIG. 4, coaxial through holes 15 having right-and-left directed axes are formed in the stationary side walls 9, bearings 16 are mounted to the through holes 15, and a rotary shaft 17 having a right-and-left directed axis is rotatably bridged over the bearings 16. The rotary shaft 17 is structured such that the rotary shaft 17 is rotated by a motor 18 (refer to FIG. 1) in the direction of an arrow A. Further, a left spiral portion 19 is formed on an inner portion of a left end portion of the rotary shaft 17, a right spiral portion 20 is formed on an inner portion of a right end portion thereof, and the left and right spiral portions 19 and 20 are formed so as to oppose to the inner surfaces of the through holes 15. On the basis of the structure mentioned above, a material to be treated (including the shredded pieces) entered into a portion between the left and right spiral portions 19 and 20 and the inner surfaces of the through holes 15 is discharged to an inner portion of the casing 3, in accordance with a rotation of the rotary shaft 17 in the direction of the arrow A.

Figure 3:
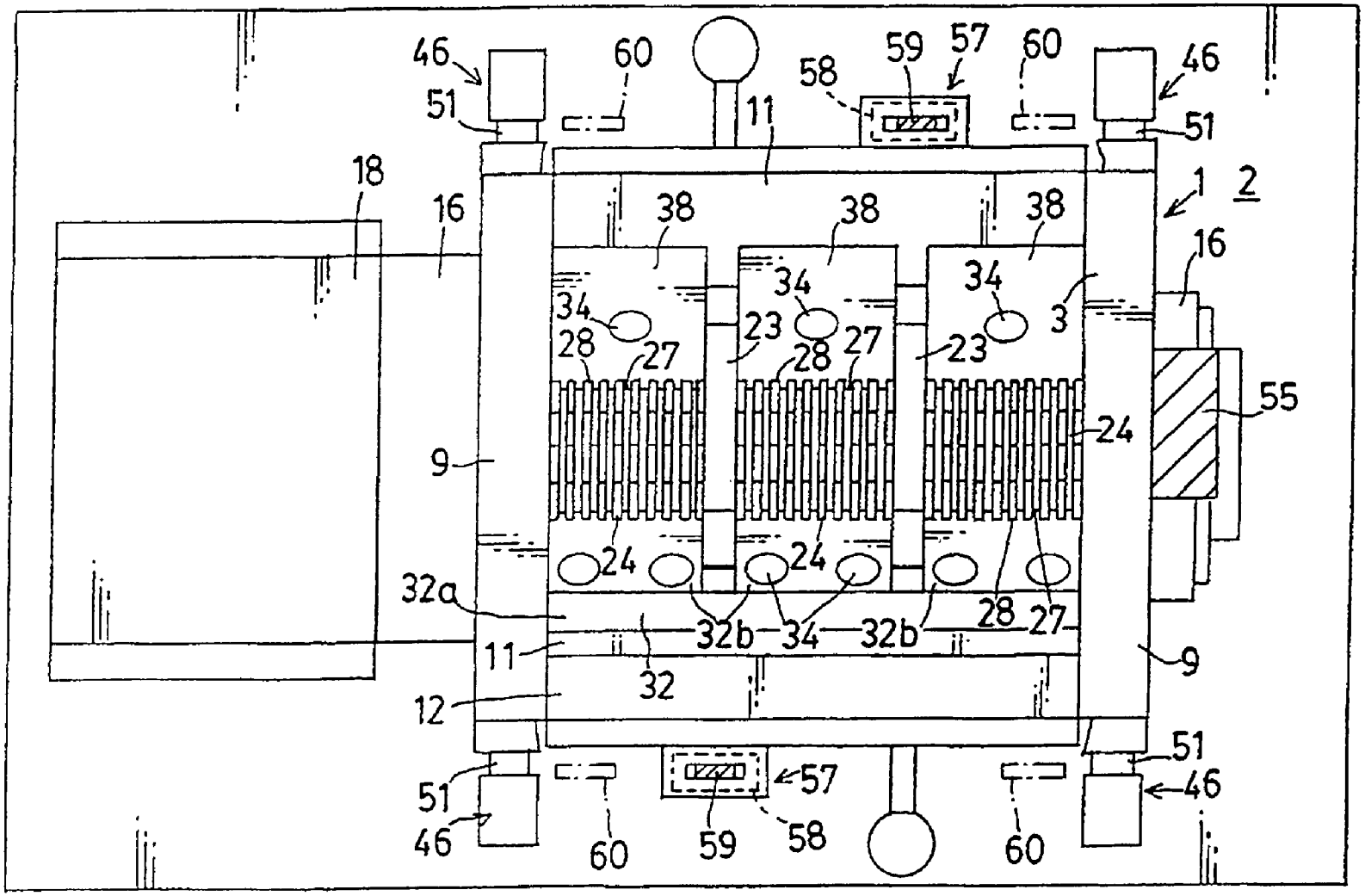
FIG. 3 is a cross sectional view along a line III-III in FIG. 1.

At least one, two in the present embodiment, arm-shaped roughly cutting rotary blades 23 are fitted and fastened to the rotary shaft 17 mentioned above so as to have a predetermined interval in the right-and-left direction and to be spaced with respect to the stationary side walls 9. Further, at least one, three in the present embodiment, finely cutting rotary blades 24 are fitted and fastened to the rotary shaft 17. In this case, the adjacent roughly cutting rotary blade 23 and finely cutting rotary blade 24 are closely contacted with each other, and the left most and right most finely cutting rotary blades 24 are opposed to the stationary side walls 9 with slight spaces so as not to prevent the rotation thereof. a rectangular hole 25 for a rotary tool is formed in the roughly cutting rotary blade 23. In accordance with the structure mentioned above, it is possible to fit the rotary tool to the rectangular hole 25 so as to manually rotate the roughly cutting rotary blade 23. Annular grooves 27 are formed in the finely cutting rotary blade 24 with a predetermined interval in the right-and-left direction, and a sawtooth-shaped shredding teeth 29 are formed in a protruding portion 28 between the annular groove 27 and the annular groove 27 (refer to FIG. 7).

a stationary blade 32 for shredding the material to be treated in cooperation with the roughly cutting rotary blade 23 and the finely cutting rotary blade 24 is mounted to an inner side of the front oscillating side wall 11 so as to decline rearward. The stationary blade 32 has a front member 32*a* which is long in the right-and-left direction and is positioned in a front side of a moving locus of a leading end of the roughly cutting rotary blade 23, and a rear member 32*b* (refer to FIG. 3) which is provided independently from the front member 32*a* and is separated at a position of a moving locus of the roughly cutting rotary blade 23.

Figure 7:
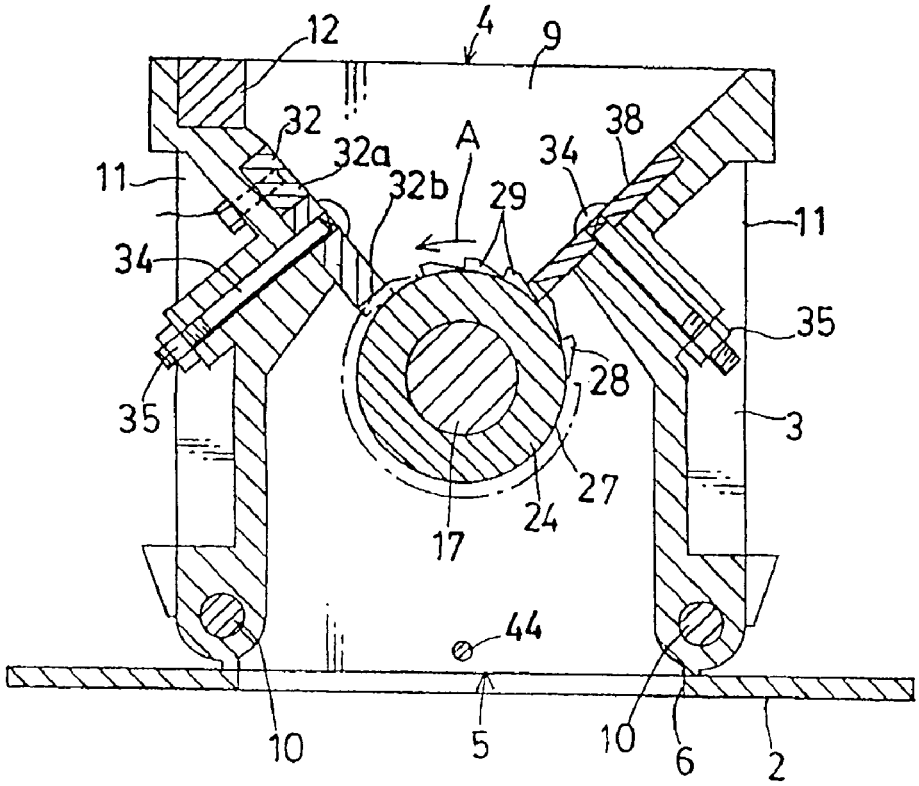
FIG. 7 is a cross sectional view along a line VII-VII in FIG. 1.

The front member 32*a* is fixed to the front oscillating side wall 11 by a desired number of bolts 33 as shown in FIG. 7, and a rear edge portion facing to the moving locus of the roughly cutting rotary blade 23 functions as a blade (a blade for shredding the material to be treated in cooperation with the roughly cutting rotary blade 23).

The rear member 32*b* is fixed to the front oscillating side wall 11 by a desired number of bolts 34 and nuts 35 as shown in FIG. 7, and a rear edge portion facing to the moving locus of the roughly cutting rotary blade 23 functions as a blade (a blade for shredding the material to be treated in cooperation with the roughly cutting rotary blade 23). Further, the rear edge portion of the rear member 32*b* is formed in a concavo-convex shape so as to be engaged with the finely cutting rotary blade 24 (refer to FIG. 3), and the concavo-convex portion serves as a blade (a blade for shredding the material to be treated in cooperation with the finely cutting rotary blade 24). a head of the bolt 34 is formed in an upward convex curved shape having no recess to which the treated material may be fitted. Further, an upper portion of a shaft portion (a portion below the head portion) of the bolt 34 is formed to be a rectangular shaft portion (a shaft having a rectangular cross section), and the rectangular shaft portion is fitted to the rectangular hole formed in the rear member 32*b*, thereby preventing the bolt 34 from relatively rotating with respect to the rear member 32*b*.

Three scrapers 38 for scraping out the treated material in cooperation with the finely cutting rotary blade 24 are mounted to the inner side of the rear oscillating side wall 11 so as to decline frontward. The scrapers 38 are arranged so as to be prevented from being collided and interfered with the roughly cutting rotary blade 23. The scrapers 38 are fixed to the rear oscillating side wall 11 by desired number of bolts 34 and nuts 35 as shown in FIG. 7, a front edge portion of each of the scrapers 38 is formed in a concavo-convex shape (refer to FIG. 3) so as to be engaged with the finely cutting rotary blade 24, and the concavo-convex portion serves as a scraping portion (a portion for scraping out the treated material in cooperation with the finely cutting rotary blade 24).

In accordance with the structure mentioned above, the roughly cutting rotary blade 23 and the finely cutting rotary blade 24 are positioned between the stationary blade 32 and the scraper 38.

Figure 5:
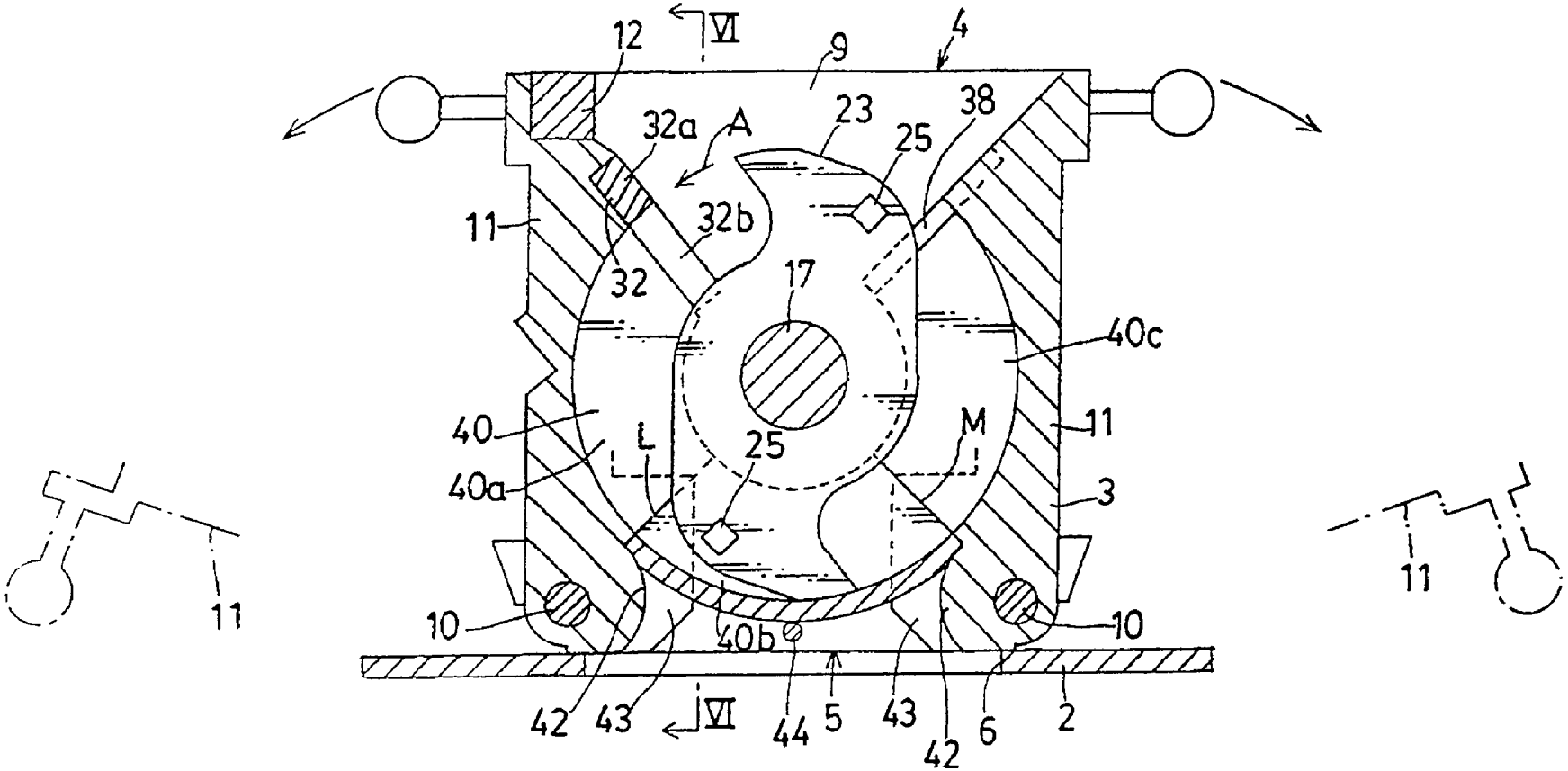
FIG. 5 is a cross sectional view along a line V-V in FIG. 1.
Figure 6:
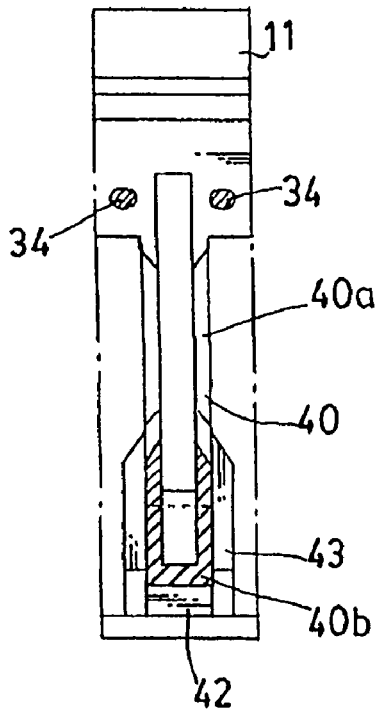
FIG. 6 is a cross sectional view along a line VI-VI in FIG. 5 from which a stationary blade is deleted.

As shown in FIGS. 5 and 6, a cover member 40 for covering a moving locus space of the roughly cutting rotary blade 23 is provided so as to be positioned below the stationary blade 32 and the scraper 38. The cover member 40 has a front member 40*a* provided in the front oscillating side wall 11, a rear member 40*c* provided in the rear oscillating side wall 11, and an intermediate member 40*b* connecting the front member 40*a* and the rear member 40*c* and provided independently therefrom. In this case, in FIG. 5, a boundary between the front member 40*a* and the intermediate member 40*b* is shown by "L", and a boundary between the intermediate member 40*b* and the rear member 40*c* is shown by "M".

The intermediate member 40*b* is provided so as to be freely attached to and detached from the casing 3 by the following means.

The front and rear oscillating side walls 11 are provided with bearing members 42 for bearing the intermediate member 40*b* of the cover member 40 in the state of the front and rear oscillating side walls 11 being opened. Further, the front and rear oscillating side walls 11 are provided with a holder 43 for inhibiting the intermediate member 40*b* from moving rightward and leftward. Further, the structure is made such that the intermediate member 40*b* is inhibited from moving frontward and rearward at a time of closing the front and rear oscillating side walls 11 (at a time of setting them to an upright state) by means of the front and rear bearing members 42, the front member 40*a* and the rear member 40*c*, and is also inhibited from moving rightward and leftward by means of the holder 43. Further, a supporting rod 44 supporting the lower portion of the intermediate member 40*b* in the fixed state as mentioned above is bridged and fastened over the lower portions of the right and left stationary side walls 9. The supporting rod 44 serves as a rod for supporting the intermediate member 40*b* at a time of bridging the intermediate member 40*b* of the cover member 40 between the bearing members 42 in the state of the front and rear oscillating side walls 11 being opened. In accordance with the structure mentioned above, since it is possible to easily take out the intermediate member 40*b* from the casing 3 by opening the front end rear oscillating side walls 11, it is possible to easily clean the inner side of the intermediate member 40*b*.

Figure 8:
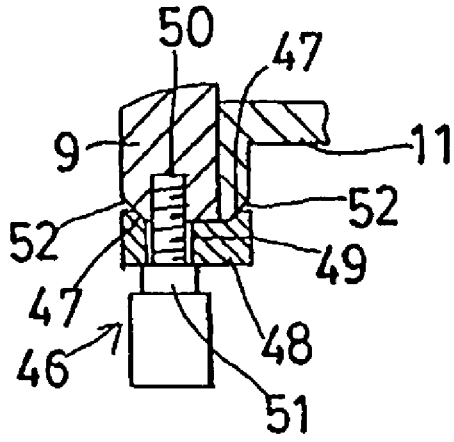
FIG. 8 is a cross sectional view along a line VIII-VIII in FIG. 1.
Figure 9:
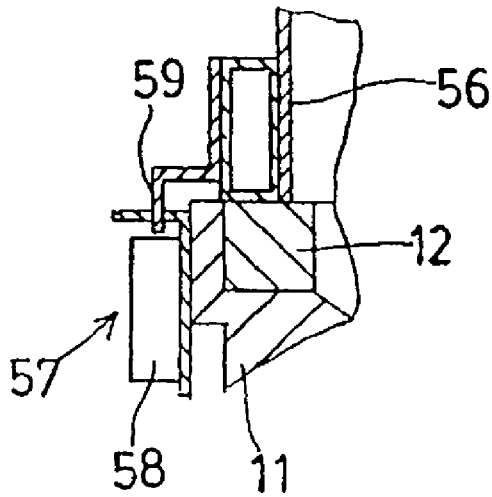
FIG. 9 is a cross sectional view along a line IX-IX in FIG. 1.

The front and rear oscillating side walls 11 are structured such as to be locked by lock apparatuses 46 shown in FIG. 8 at the position shown in FIG. 5.

The lock apparatus 46 has a lock piece 48 having taper surfaces 47, which oppose to each other and open toward a leading end side as seen from the above, and being formed in a C shape in a plan view, a handled screw 51 screwed into a threaded hole 50 formed in the stationary side wall 9 through a through hole 49 formed in the lock piece 48, an inclined surface 52 formed in the stationary side wall 9 so as to oppose to the taper surface 47, and an inclined surface formed in the oscillating side wall 11. In accordance with the structure mentioned above, the oscillating side wall 11 can be locked to the stationary side wall 9 by opposing the taper surfaces 47 to the inclined surfaces 52 and thereafter fastening the screw 51 so as to press the taper surfaces 47 against the inclined surfaces 52.

a hopper 56 is provided in the right stationary side wall 9 via a hinge 55 so as to freely oscillate and to be opened and closed. In this case, the hopper 56 is structured such as to be fixed to the left stationary side wall 9 by a known lock apparatus (not shown) in the state shown in FIG. 1.

Interlocking apparatuses 57 are provided in the hopper 56 and the oscillating side walls 11. The interlocking apparatus 57 has a reflection type photoelectric switch 58 provided in the upper portion of the oscillating side wall 11, and a detected piece 59 provided in the hopper 56, which is to be detected by the photoelectric switch 58 in the state shown in FIG. 1. Further, the structure is made such that the motor 18 is not operated even by turning on the main switch of the shredder 1, until the photo electric switch 58 detects the detected piece 59, that is, until the oscillating side wall 11 is closed (in the upright state) and the hopper 56 is in the state of being mounted on the casing 3. Receiving pieces 60 inhibiting the oscillating side wall 11 from accidentally opening are provided in the lower portion of the hopper 56.

An operation of the shredder 1 is the same as the conventional one.

a description will be given below of modified embodiments and the like.

(1) The roughly cutting rotary blade 23 and the finely cutting rotary blade 24 correspond to the rotary blade in claim 1. The structures of the roughly cutting rotary blade 23 and the finely cutting rotary blade 24 are optional.

(2) The interlocking apparatus 57 may be omitted.

INDUSTRIAL APPLICABILITY

The present invention can be widely applied to shredding of various raw materials.

What is claimed is:

1. A shredder comprising:

a pair of stationary side walls arranged with a predetermined interval;

a rotary shaft rotatably bridged over the stationary side walls and having a rotary blade;

a pair of support shafts bridged and fastened over lower end portions of the pair of stationary side walls in parallel with the rotary shaft;

pivotable side walls provided on each of the support shafts so as to pivot freely to be opened and closed;

a stationary blade provided in an inner side of one of the pivotable side walls and shredding a material to be treated in cooperation with the rotary blade; and a scraper provided in an inner side of the other pivotable side wall, wherein the rotary blade is positioned between the stationary blade and the scraper, and wherein said rotary blade is provided with an arm-shaped roughly cutting rotary blade and a finely cutting rotary blade having sawtooth-shaped shredding teeth in an outer periphery, a cover member for covering a moving locus space of the roughly cutting rotary blade is provided so as to be positioned below the stationary blade and the scraper, said cover member having:

a first side member provided in one of the pivotable side walls;

a second side member provided in the other pivotable side wall; and an intermediate member connecting the first side member and the second side member, being independent of the first and second side members and detachable from the shredder when said pivotable side walls are opened.

2. The shredder as claimed in claim 1, wherein:

each stationary side wall includes a through hole which is coaxial with the rotary shaft, and left and right end portions of the rotary shaft insert into the through holes in the respective stationary side walls, a left spiral portion is formed on one end portion of the rotary shaft, a right spiral portion is formed on the other end portion of the rotary shaft, and the right and left spiral portions are arranged so as to oppose to the inner surfaces of the respective through holes.

3. The shedder as claimed in claim 2, wherein the left and right spiral portions are respectively provided with left-handed and right-handed spirals.

4. The shredder as claimed in claim 1, wherein a rectangular hole is formed in a side wall of the roughly cutting rotary blade.

5. The shredder as claimed in claim 1, wherein the stationary blade and the scraper are fixed with bolts in an inner side of the pivotable side wall and in an inner side of the other pivotable side wall respectively, and a head portion of each bolt is formed in an upward convex curved shape.

6. The shedder as claimed in claim 1, comprising a lock piece having taper surfaces, which oppose to each other and open toward a leading end side in a plan view, and being formed in a C shape in a plan view;

a through hole formed in the lock piece;

an inclined surface formed in the stationary side wall and in the oscillating side wall respectively, so as to oppose to the taper surfaces; and a threaded hole formed in the stationary side wall in which a screw penetrating the through hole is screwed; wherein the oscillating side wall is fixed to the stationary side wall by fastening the screw so as to press the taper surfaces against the inclined surfaces.

7. A shedder comprising:

a pair of stationary side walls arranged with a predetermined interval;

connection members bridged and fastened over upper portions of the stationary side walls;

a rotary shaft rotatably bridged over the stationary side walls and having a rotary blade a pair of support shafts bridged and fastened over lower end portions of the pair of stationary side walls in parallel with the rotary shaft;

pivotable side walls provided to each of the support shafts so as to freely oscillate to be opened and closed;

a stationary blade provided in an inner side of one of the pivotable side walls and shredding a material to be treated in cooperation with the rotary blade; and a scraper provided in an inner side of the other pivotable side wall, wherein the rotary blade is positioned between the stationary blade and the scraper, and wherein the rotary blade is provided with an arm-shaped roughly cutting rotary blade and a finely cutting rotary blade having sawtooth-shaped shredding teeth in an outer periphery, a cover member covering a moving locus space of the roughly cutting rotary blade being positioned below the stationary blade and the scraper, said cover member having:

a first side member provided in one of the pivotable side walls;

a second side member provided in the other pivotable side wall; and an intermediate member connecting the first side member and the second side member, being independent of the first and second side members and detachable from the shredder when said pivotable side walls are opened.

8. A shredder comprising:

a pair of stationary side walls arranged with a predetermined interval;

a rotary shaft rotatably bridged over the stationary side walls and having a rotary blade;

a pair of support shafts bridged and fastened over lower end portions of the pair of stationary side walls in parallel with the rotary shaft;

pivotable side walls provided on each of the support shafts so as to pivot freely to be opened and closed;

a stationary blade provided in an inner side of one of the pivotable side walls and shredding a material to be treated in cooperation with the rotary blade; and a scraper provided in an inner side of the other pivotable side wall, wherein the rotary blade is positioned between the stationary blade and the scraper, and wherein said rotary blade is provided with an arm-shaped roughly cutting rotary blade and a finely cutting rotary blade having sawtooth-shaped shredding teeth in an outer periphery, a cover member for covering a moving locus space of the roughly cutting rotary blade is provided so as to be positioned below the stationary blade and the scraper, said cover member having:

a first side member provided in one of the pivotable side walls;

a second side member provided in the other pivotable side wall; and an intermediate member connecting the first side member and the second side member, being independent of the first and second side members and detachable, each stationary side wall including a through hole which is coaxial with the rotary shaft, and left and right end portions of the rotary shaft insert into the through holes in the respective stationary side walls, a left spiral portion being formed on one end portion of the rotary shaft, a right spiral portion being formed on the other end portion of the rotary shaft, and the right and left spiral portions being arranged so as to oppose to the inner surfaces of the respective through holes.

9. A shredder comprising:

a pair of stationary side walls arranged with a predetermined interval;

a rotary shaft rotatably bridged over the stationary side walls and having a rotary blade;

a pair of support shafts bridged and fastened over lower end portions of the pair of stationary side walls in parallel with the rotary shaft;

pivotable side walls provided on each of the support shafts so as to pivot freely to be opened and closed;

a stationary blade provided in an inner side of one of the pivotable side walls and shredding a material to be treated in cooperation with the rotary blade; and a scraper provided in an inner side of the other pivotable side wall, wherein the rotary blade is positioned between the stationary blade and the scraper, and wherein said rotary blade is provided with an arm-shaped roughly cutting rotary blade and a finely cutting rotary blade having sawtooth-shaped shredding teeth in an outer periphery, a cover member for covering a moving locus space of the roughly cutting rotary blade is provided so as to be positioned below the stationary blade and the scraper, said cover member having:

a first side member provided in one of the pivotable side walls;

a second side member provided in the other pivotable side wall; and an intermediate member connecting the first side member and the second side member, being independent of the first and second side members and detachable, the shredder further comprising:

a lock piece having taper surfaces, which oppose to each other and open toward a leading end side in a plan view, and being formed in a C shape in a plan view;

a through hole formed in the lock piece;

an inclined surface formed in the stationary side wall and in the pivotable side wall respectively, so as to oppose to the taper surfaces; and a threaded hole formed in the stationary side wall in which a screw penetrating the through hole is screwed; wherein the pivotable side wall is fixed to the stationary side wall by fastening the screw so as to press the taper surfaces against the inclined surfaces.

10. A shredder comprising:

a pair of stationary side walls arranged with a predetermined interval;

a rotary shaft rotatably bridged over the stationary side walls and having a rotary blade;

a pair of support shafts bridged and fastened over lower end portions of the pair of stationary side walls in parallel with the rotary shaft;

pivotable side walls provided on each of the support shafts so as to pivot freely to be opened and closed;

a stationary blade provided in an inner side of one of the pivotable side walls and shredding a material to be treated in cooperation with the rotary blade; and a scraper provided in an inner side of the other pivotable side wall, wherein the rotary blade is positioned between the stationary blade and the scraper, and wherein said rotary blade is provided with an arm-shaped roughly cutting rotary blade and a finely cutting rotary blade having sawtooth-shaped shredding teeth in an outer periphery, a cover member for covering a moving locus space of the roughly cutting rotary blade is provided so as to be positioned below the stationary blade and the scraper, said cover member having:

a first side member provided in one of the pivotable side walls;

a second side member provided in the other pivotable side wall; and an intermediate member connecting the first side member and the second side member, being independent of the first and second side members and detachable each stationary side wall including a through hole which is coaxial with the rotary shaft, and left and right end portions of the rotary shaft insert into the through holes in the respective stationary side walls, a left spiral portion being formed on one end portion of the rotary shaft, a right spiral portion being formed on the other end portion of the rotary shaft, the right and left spiral portions being arranged so as to oppose to the inner surfaces of the respective through holes, the left and right spiral portions being respectively provided with left-handed and right-handed spirals.

* * * * *